US010376028B2

(12) United States Patent
Poss

(10) Patent No.: US 10,376,028 B2
(45) Date of Patent: Aug. 13, 2019

(54) CONVERTIBLE TRAVEL BAG FOR BOOTS

(71) Applicant: Switch Designs, LLC, Jackson, WY (US)

(72) Inventor: James Poss, Jackson, WY (US)

(73) Assignee: SWITCH DESIGNS, LLC, Denver, CO (US)

( * ) Notice: Subject to any disclaimer, the term of this patent is extended or adjusted under 35 U.S.C. 154(b) by 0 days.

(21) Appl. No.: 15/827,095

(22) Filed: Nov. 30, 2017

(65) Prior Publication Data

US 2018/0255887 A1 Sep. 13, 2018

Related U.S. Application Data

(60) Provisional application No. 62/470,514, filed on Mar. 13, 2017.

(51) Int. Cl.

| | |
|---|---|
| ***A45C 3/12*** | (2006.01) |
| ***A45C 7/00*** | (2006.01) |
| ***A45F 4/02*** | (2006.01) |
| ***A45C 9/00*** | (2006.01) |
| ***A45F 3/04*** | (2006.01) |
| *A43B 5/04* | (2006.01) |
| *A45F 3/00* | (2006.01) |
| *A45C 3/00* | (2006.01) |

(52) U.S. Cl.

CPC ..... *A45C 3/12* (2013.01); *A45C 7/0077* (2013.01); *A45C 9/00* (2013.01); *A45F 3/04* (2013.01); *A45F 4/02* (2013.01); *A43B 5/0425* (2013.01); *A45C 2003/007* (2013.01); *A45C 2003/008* (2013.01); *A45C 2009/007* (2013.01); *A45F 3/00* (2013.01); *A45F 2004/023* (2013.01); *A63C 2203/44* (2013.01)

(58) Field of Classification Search

CPC .. A45C 13/03; A45C 3/12; A45C 3/00; A45C 3/004; B65D 85/18; B65D 77/26; B65D 85/182

USPC ..... 206/292; 224/153, 413, 651–653

See application file for complete search history.

(56) References Cited

U.S. PATENT DOCUMENTS

| | | | | | |
|---|---|---|---|---|---|
| 3,061,057 | A | * | 10/1962 | Miller | A45C 7/0086 190/110 |
| 4,258,869 | A | * | 3/1981 | Hilgendorff | A45F 3/00 224/408 |
| 4,424,841 | A | * | 1/1984 | Smith | A45C 7/0086 190/102 |
| 4,491,258 | A | * | 1/1985 | Jones | B62J 9/00 224/153 |
| D293,626 | S | | 1/1988 | Beran | |
| 4,884,731 | A | * | 12/1989 | Sibley | A45F 3/04 224/651 |
| D312,726 | S | | 12/1990 | Kline | |

(Continued)

*Primary Examiner* — Fenn C Mathew
*Assistant Examiner* — Cynthia F Collado

(57) ABSTRACT

A convertible travel bag includes a first compartment, a second compartment rotatably coupled to the first compartment, and a third compartment rotatably coupled to the first compartment. The second compartment and the third compartment are rotatable between a backpack mode and a side-carry mode. In the backpack mode, the first compartment is positioned between the second compartment and the third compartment, and in the side-carry mode, the first compartment is longitudinally in line with both the second compartment and the third compartment.

19 Claims, 6 Drawing Sheets

(56) References Cited

U.S. PATENT DOCUMENTS 4,979,658 A * 12/1990 Baker ..... A45F 3/04 224/153
5,395,023 A * 3/1995 Naymark ..... A45C 11/38 224/199
5,456,353 A 10/1995 Challoner
5,509,589 A 4/1996 Kliot
5,544,792 A * 8/1996 Arnwine ..... A45C 7/0086 224/153
5,765,733 A * 6/1998 Brule ..... A45F 3/04 224/153
5,826,771 A * 10/1998 Peng ..... A45F 3/04 224/651
5,881,708 A * 3/1999 Kliot ..... A43B 5/0425 224/582
6,547,114 B2 * 4/2003 Smith ..... A45C 7/0045 224/413
6,637,633 B1 * 10/2003 Eberle ..... A45C 7/0059 190/103
6,786,375 B2 * 9/2004 Worden ..... A45C 3/12 206/315.1
8,820,596 B1 * 9/2014 Bergquist ..... A45F 4/02 224/153
D781,574 S * 3/2017 Bedford ..... D3/217
2005/0194413 A1 * 9/2005 Baker ..... A45C 3/14 224/153
2007/0152005 A1 * 7/2007 Bui ..... A45C 7/0095 224/577
2009/0206118 A1 * 8/2009 Sabbah ..... A45C 13/02 224/652
2010/0108730 A1 * 5/2010 Sabbah ..... A45F 3/04 224/651
2011/0180575 A1 * 7/2011 Abramowitz ..... A45C 15/00 224/259
2013/0026204 A1 1/2013 Abramowitz
2017/0245626 A1 * 8/2017 Nehmad ..... A45F 4/02

* cited by examiner

CONVERTIBLE TRAVEL BAG FOR BOOTS

CROSS-REFERENCE TO RELATED APPLICATIONS

This application claims priority to and the benefit of U.S. Provisional Patent Application No. 62/470,514, filed Mar. 13, 2017, entitled "CONVERTIBLE TRAVEL BAG FOR BOOTS," the disclosure of which is hereby incorporated by reference herein in its entirety.

INTRODUCTION

Athletic footwear is typically tailored for a specific activity, such as, ski boots for skiing, snowboard boots for snowboarding, ice skates for ice skating, roller skates for roller skating, hiking/mountaineering boots for mountain climbing, winter boots for snowshoeing, etc. These types of footwear are typically the most important piece of gear for the activity, but often bulky and notoriously difficult to carry and transport.

At least some known travel bags are specifically designed to carry these various types of athletic footwear, as well have space for additional gear and equipment storage. These known travel bags, however, can be functionally awkward to travel with and carry. At least some known travel bags are designed as backpacks for carrying the footwear on the back. These known backpacks may increase comfort while carrying the footwear on the back and free up hands for carrying other gear and equipment, however, these backpacks are very awkward to carry when not positioned on the back. Additionally, these known backpacks are limited in space, do not pack easily, and do not store well for travel in airplanes or motor vehicles.

At least some other known travel bags are designed as duffel bags for carrying the footwear by hand. These known duffel bags are elongate and may increase the space available for additional equipment storage, however, the duffel bags do not function well as backpacks and thus do not free up hands for carrying any other gear and equipment. Some duffel bags may include a wheeled or roller design to increase ease of transport, but this still does not free up hands for carrying any other gear and equipment.

SUMMARY

In one aspect, the technology relates to a convertible travel bag including: a first compartment; a second compartment rotatably coupled to the first compartment; and a third compartment rotatably coupled to the first compartment; wherein the second compartment and the third compartment are rotatable between a backpack mode and a side-carry mode, and wherein in the backpack mode, the first compartment is positioned between the second compartment and the third compartment, and in the side-carry mode, the first compartment is longitudinally in line with both the second compartment and the third compartment.

In an example, when the convertible travel bag is in the side-carry mode, the second compartment is disposed adjacent to the third compartment. In another example, the second compartment and the third compartment are each rotatably coupled to the first compartment about a hinge, wherein each hinge includes a reinforced fabric. In yet another example, a releasable buckle mechanism is configured to couple the second compartment to the third compartment in both the backpack mode and the side-carry mode. In still another example, the travel bag includes a back wall and at least one backpack strap, the at least one backpack strap extends from a top portion of the back wall and is adjustably secured to a bottom portion of the back wall via an adjustment mechanism, and wherein when the convertible travel bag is in the side-carry mode, the at least one backpack strap is configured to be secured against the back wall by pulling a free end of the at least one backpack strap in a direction from the bottom portion towards the top portion. In an example, the at least one backpack strap includes a hook positioned proximate the top portion for securing the free end thereto. In another example, the second compartment and the third compartment are configured to receive and store at least one of a ski boot and a snowboard boot. In yet another example, a size as measured by volume of the first compartment is approximately equal to a combined size as measured by volume of the second compartment and the third compartment.

In another aspect, the technology relates to a travel bag including: a gear compartment including a first back wall, a first side wall, and an opposite second side wall; a first footwear compartment including a second back wall, a third side wall, and an opposite fourth side wall; a second footwear compartment including a third back wall, a fifth side wall, and an opposite sixth side wall; wherein the travel bag is configurable between a first carry mode and a second carry mode, and wherein when the travel bag is in the first carry mode, the gear compartment is disposed between the first footwear compartment and the second footwear compartment such that the first side wall is positioned adjacent to and faces the fourth side wall and the second side wall is positioned adjacent to and faces the fifth side wall, and when the travel bag is in the second carry mode, the gear compartment is disposed longitudinally in line with both the first footwear compartment and the second footwear compartment such that the first back wall is positioned adjacent to and faces both the second back wall and the third back wall.

In an example, when the travel bag is in the first carry mode, all of the back walls, the third side wall, and the sixth side wall form at least a portion of an exterior surface of the travel bag. In another example, when the travel bag is in the second carry mode, the first side wall, the second side wall, the fourth side wall, and the fifth side wall form at least a portion of an exterior surface of the travel bag. In yet another example, each of the side walls includes one or more fasteners, and wherein the one or more fasteners are configured to secure to an adjacent fastener such that two side walls are secured together. In still another example, the one or more fasteners are positioned towards a top portion of each of the side walls. In an example, both the first footwear compartment and the second footwear compartment rotate relative to the gear compartment between the first carry mode and the second carry mode. In another example, the gear compartment further includes at least one backpack strap extending from the first back wall. In yet another example, a longitudinal length of the gear component is approximately equal to a longitudinal length of each of the first footwear compartment and second footwear compartment.

In another aspect, the technology relates to a method of converting a travel bag from a backpack mode to a side-carry mode, wherein the travel bag includes a first compartment, a second compartment, and a third compartment, and wherein when in the backpack mode, the first compartment is positioned between the second compartment and the third compartment, the method including: releasing a buckle mechanism that couples the second compartment to the third compartment; rotating the second compartment relative to the first compartment such that the second compartment is longitudinally in line with the first compartment; rotating the third compartment relative to the first compartment such that the third compartment is longitudinally in line with the first compartment and is disposed proximate the second compartment; and engaging the buckle mechanism to couple the second compartment to the third compartment to form the side-carry mode.

In an example, the second compartment and the third compartment are rotated approximately 180° between the backpack mode and the side-carry mode. In another example, the method also includes securing at least one backpack strap against a back wall of the first compartment. In yet another example, before rotating the second compartment and the third compartment, the method includes releasing at least one first fastener securing the second compartment to the first compartment and at least one second fastener securing the third compartment to the first compartment, and after rotating the second compartment and the third compartment, fastening at least one third fastener securing the second compartment to the third compartment.

BRIEF DESCRIPTION OF THE DRAWINGS

There are shown in the drawings embodiments that are presently preferred, it being understood, however, that the invention is not limited to the precise arrangements and configurations shown.

DETAILED DESCRIPTION

This disclosure describes a convertible travel bag that is configurable in two carry modes as needed to distribute weight, store the bag during travel (e.g., overhead compartment, vehicle trunks), etc. In the example, the travel bag is configurable in both a first backpack mode and a second side-carry mode. When the travel bag is in the backpack mode, the gear and boots contained therein may be easily carried on one's back so as to free up hands to carry other gear and equipment, for example skis or a snowboard. However, in the backpack mode, the travel bag may be difficult to store or stack with other equipment or bags and is frustrating to carry on one's side with a single hand. As such, to facilitate reducing these types of issues and increasing versatility, the travel bag is quickly and easily convertible into the side-carry mode. In the example described herein, the travel bag is separated into three compartments: two footwear compartments and a gear compartment. The footwear compartments are attached to the gear compartments such that the footwear compartments rotate between the backpack mode, when the gear compartment is positioned between the two footwear compartments, and the side-carry mode, when the gear compartment is longitudinally in line with both the two footwear compartments.

Throughout this description, references to orientation (e.g., front(ward), rear(ward), top, bottom, back, right, left, upper, lower, etc.) of the travel bag are used for ease of description and illustration, and no restriction is intended by use of the terms regardless of how the travel bag may be situated on its own.

Figure 1:
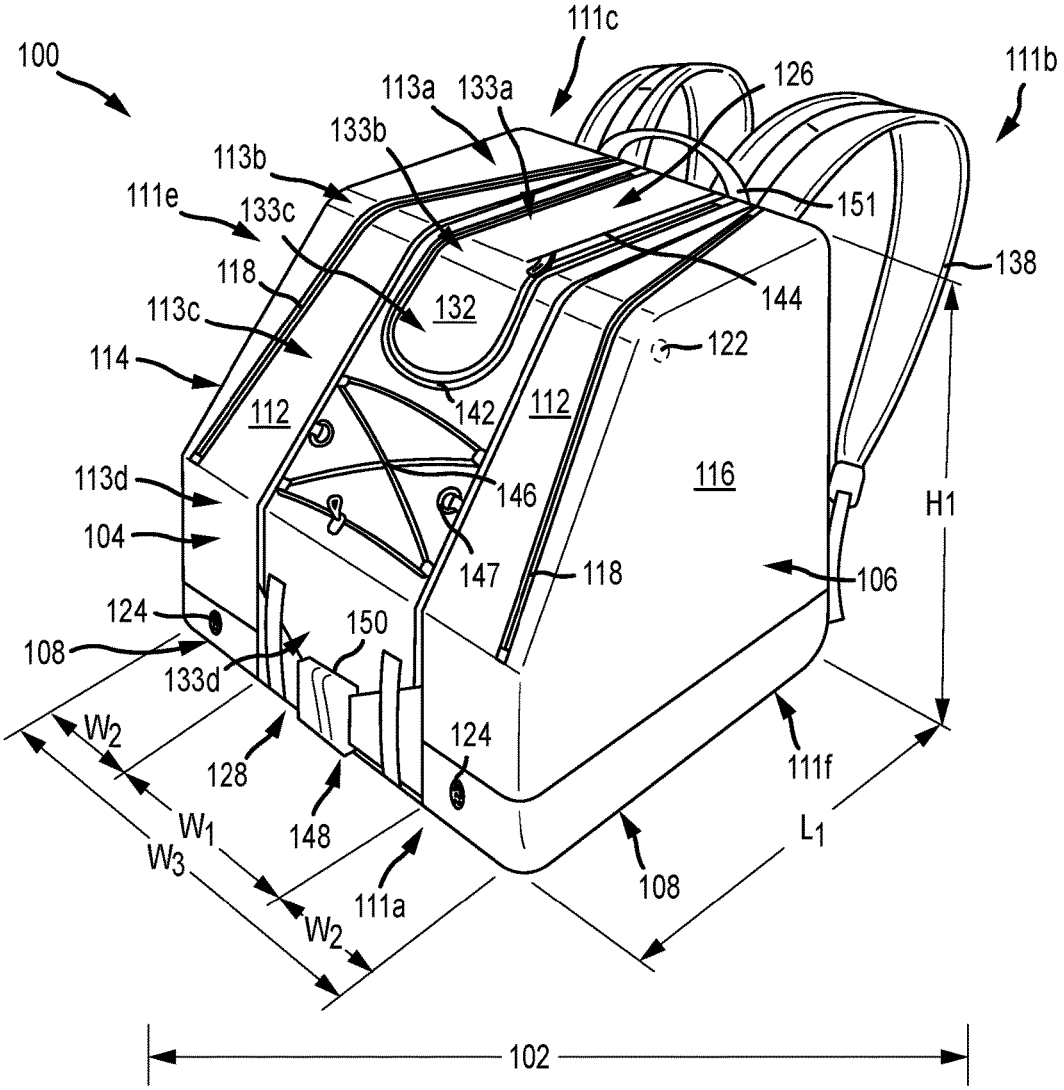
FIG. 1 is a front perspective view of an example convertible travel bag in a backpack mode.
Figure 2:
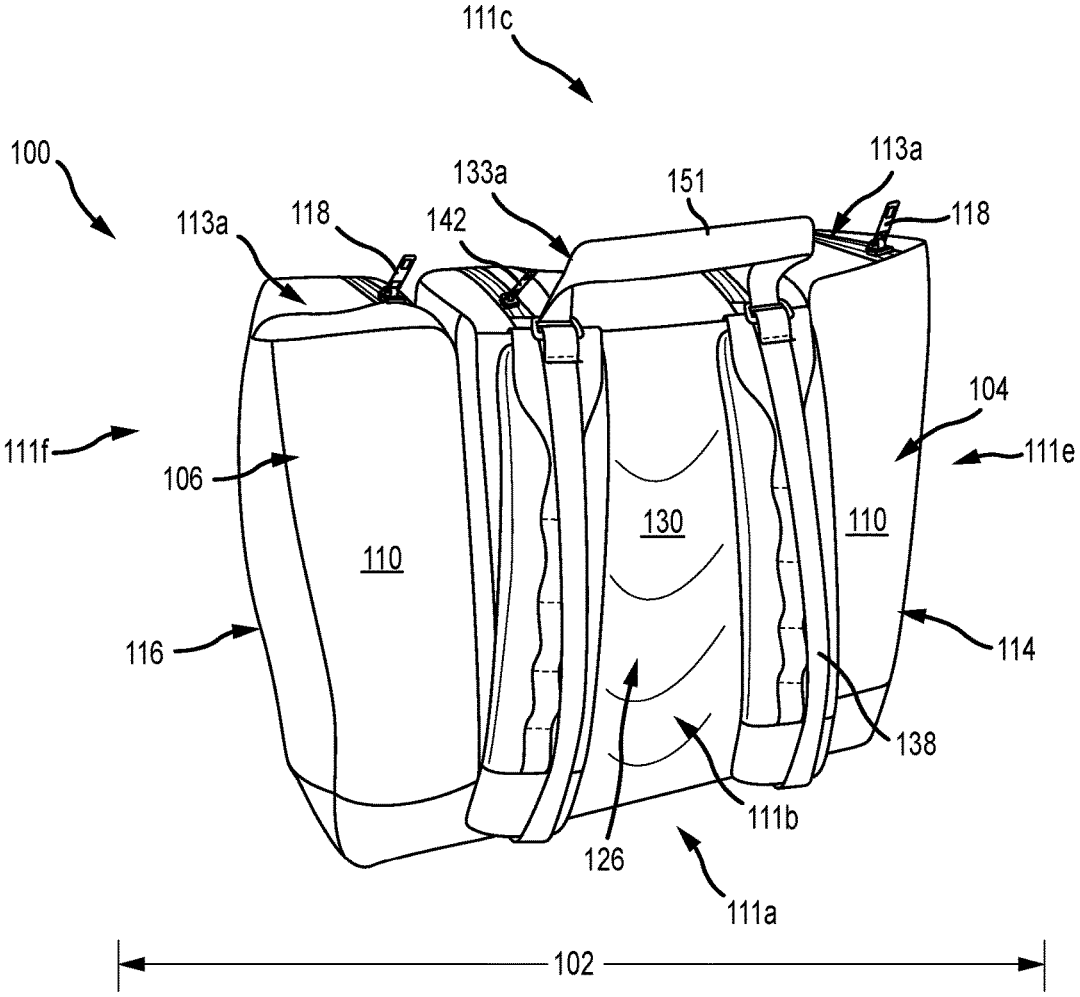
FIG. 2 is a rear perspective view of the convertible travel bag in the backpack mode.

FIG. 1 is a front perspective view of an example convertible travel bag 100. FIG. 2 is a rear perspective view of the convertible travel bag 100. Referring concurrently to FIGS. 1 and 2, the travel bag 100 is illustrated in a backpack mode 102. The travel bag 100 includes a first footwear compartment 104 and a second footwear compartment 106. Each compartment 104, 106 is configured to receive and retain footwear for carrying and traveling. For example, each compartment 104, 106 is sized and shaped to receive and retain ski and/or snowboard boots with the sole of the boot positioned along a bottom wall 108 of the compartments 104, 106 and the shaft of the boot extending upwards along a back wall 110 (shown in FIG. 2) of the compartments 104, 106. The bottom wall 108 at least partially forms a bottom 111*a* of the travel bag 100 and the back wall 110 at least partially forms a back 111*b* of the travel bag 100 in the backpack mode 102. In alternative examples, each compartment 104, 106 is sized and shaped to receive and retain any other footwear, for example, but not limited to, ice and/or roller skates, mountaineering boots, hiking boots, and winter boots.

Each compartment 104, 106 includes a front wall 112 that extends from the bottom wall 108 to the back wall 110. The front wall 112 includes a top face 113*a* that at least partially forms a top 111*c* of the travel bag 100, a radius face 113*b* that defines a transition from the top 111*c* to a front 111*d* of the travel bag 100, a chamfered face 113*c* that at least partially forms the front 111*d* of the travel bag 100, and a front face 113*d* that also at least partially forms the front 111*d* of the travel bag 100. Each compartment 104, 106 also includes a first side wall 114 opposite a second side wall 116. The first side wall 114 of the first compartment 104 forms a left 111*e* of the travel bag 100 and the second side wall 116 of the second compartment 106 forms a right 111*f* of the travel bag 100 in the backpack mode 102.

The front wall 112 of each compartment 104, 106 includes at least one zipper opening 118 positioned between the side walls 114, 116 and extending from the top face 113*a*, through the radius face 113*b*, and to the chamfered face 113*c*. In the example, on the first compartment 104 the zipper 118 is disposed at an angle from the first side wall 114 at the chamfered face 113*c* to the second side wall 116 at the top face 113*a*. Conversely, on the second compartment 106 the zipper 118 is disposed at an angle from the second side wall 116 at the chamfered face 113*c* to the first side wall 114 at the top face 113*a*. In the example, the zipper opening 118 closes upward. This allows for equal access into the compartments 104, 106 in the backpack mode 102 and a side-carry mode 120 (shown in FIG. 4). In alternative examples, the zipper openings 118 may be centered between the side walls 114, 116 and/or access into the compartments 104, 106 may include any other closure mechanism such as buttons, flaps, or hook-and-loop fasteners, such as VELCRO™.

Each side wall 114, 116 on each compartment 104, 106 may include one or more fasteners 122 positioned towards a top-front portion of the side wall. The fasteners 122 are configured to secure to an adjacent fastener such that two side walls are at least partially secured together. In the example, the fasteners 122 may be magnets. In other examples, the fasteners 122 may be snap-buttons, hook-and-loop fasteners, or any other fastener type that enables the travel bag 100 to function as described herein. Each compartment 104, 106 may also include one or more grommets 124 configured to ventilate the compartments. In the example, the grommets 124 may be positioned at a bottom portion of the front face 113*d* of the front wall 112, although other locations are also contemplated. In some examples, the side walls 114, 116 may include a mesh panel (not shown) located at the top portion of the side wall to ventilate the compartments 104, 106. In other examples, each compartment 104, 106 may additionally or alternatively include one or more reinforced openings (not shown) that enable water (e.g., from snow/rain on the boots) to drain from the compartments 104, 106.

Between the compartments 104, 106 the travel bag 100 includes a gear compartment 126. The gear compartment 126 includes a bottom wall 128, a back wall 130, a front wall 132, and a first side wall 134 opposite a second side wall 136 (both shown in FIG. 3). The bottom wall 128 at least partially forms the bottom 111*a* of the travel bag and the back wall 130 at least partially forms the back of the travel bag 100 in the backpack mode 102. The front wall 132 extends from the bottom wall 128 to the back wall 130 and corresponds in shape to the footwear compartment front wall 112. The front wall 132 includes a top face 133*a* that at least partially forms the top 111*c* of the travel bag 100, a radius face 133*b* that defines a transition from the top 111*c* to the front 111*d* of the travel bag 100, a chamfered face 133*c* that at least partially forms the front 111*d* of the travel bag 100, and a front face 133*d* that also at least partially forms the front 111*d* of the travel bag 100.

In the backpack mode 102, the bottom 111*a*, the back 111*b*, the top 111*c*, the front 111*d*, the left 111*e*, and the right 111*f* forms an exterior of the travel bag 100. The bottom wall 128 of the gear compartment 126 and the bottom walls 108 of each footwear compartment 104, 106 have approximately similar lengths $L_1$ that corresponds to the overall length of the travel bag 100 in the backpack mode 102. In one example, the length $L_1$ may be approximately 13 inches. The back wall 130 of the gear compartment 126 and the back walls 110 of each footwear compartment 104, 106 have approximately similar heights $H_1$ that corresponds to the overall height of the travel bag 100 in the backpack mode 102. In one example, the height $H_1$ may be approximately 15 inches. The front wall 132 of the gear compartment 126 has a width $W_1$ that is approximately twice the width $W_2$ of the front walls 112 of each footwear compartment 104, 106 such that the overall width $W_3$ is defined for the travel bag 100 in the backpack mode 102. In an example, the width $W_3$ is approximately 18 inches such that the width $W_1$ is approximately 9 inches and the width $W_2$ is approximately 4.5 inches.

Each side wall 134, 136 (shown in FIG. 3) of the gear compartment 126 substantially corresponds in size and shape to the footwear compartment side walls 114, 116. As such, because of the dimensions of the travel bag 100, the size as measured by volume of the gear compartment 126 is approximately equal to a combined size as measured by volume of the footwear compartments 104, 106. Each side wall 134, 136 of the gear compartment 126 may include one or more fasteners 122 (shown in FIG. 4) positioned towards a top-front portion of the side wall. Corresponding fasteners 122 on the footwear compartments 104, 106 and the gear compartment 126 enable at least a portion of the compartments to be coupled together to facilitate the illustrated backpack mode 102.

Figure 4:
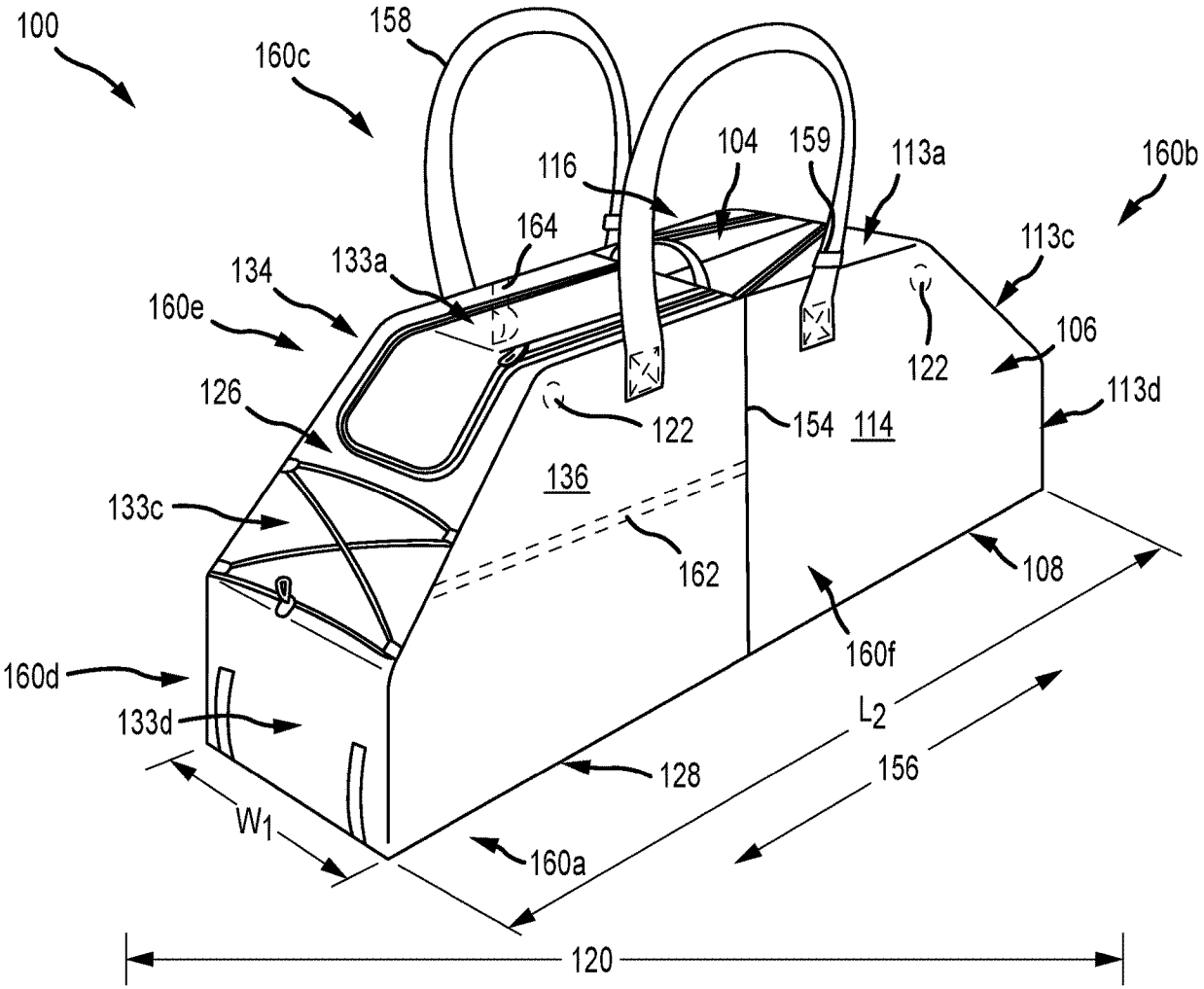
FIG. 4 is a perspective view of the convertible travel bag in the side-carry mode.

In the example, both of the footwear compartments 104, 106 are rotatably coupled to the gear compartment 126 such that the travel bag 100 is configurable between the backpack mode 102 and the side-carry mode 120 (shown in FIG. 4). Each footwear compartment 104, 106 and the gear compartment 126 are discrete compartments that cannot be accessed from one another and that are always separately accessible in both carry modes. In the backpack mode 102, the gear compartment 126 is disposed between the footwear compartments 104, 106. As such, the second side wall 116 of the first footwear compartment 104 is positioned adjacent to and faces the first side wall 134 of the gear compartment 126, and the first side wall 114 of the second footwear compartment 106 is positioned adjacent to and faces the second side wall 136 of the gear compartment 126. Also in the backpack mode 102, all side walls 114, 116, 134, and 136 are substantially parallel to one another.

Additionally, in the backpack mode 102 the bottom walls 108 of the footwear compartments 104, 106 align with the bottom wall 128 of the gear compartment 126, the back walls 110 of the footwear compartments 104, 106 align with the back wall 130 of the gear compartment 126, and the front walls 112 of the footwear compartments 104, 106 align with the front wall 132 of the gear compartment 126. In the example, back 111*b* of the travel bag 100 is defined by the aligned back walls 110, 130 of the gear compartment 126 and the footwear compartments 104, 106. In other examples, the rear of the footwear compartments may be offset from the rear gear compartment such that the back 111*b* is defined by only the gear compartment back wall 130 or the back 111*b* is defined by only the footwear compartment back walls 110.

Extending from the back wall 130 of the gear compartment 126 is a pair of adjustable padded backpack straps 138. The backpack straps 138 facilitate carrying the convertible travel bag 100 on one's back while the travel bag 100 is in the backpack mode 102. An adjustable padded waist strap (not shown) may also be provided on the back wall 130 to increase support of the travel bag 100 during use. The backpack straps 138 and/or waist strap may be stored while in the side-carry mode 120 by securing the backpack straps 138 against the back wall 130 as described further below in reference to FIGS. 5 and 6. In other examples, the backpack straps 138 may be stored within storage compartments (not shown) in the back wall 130 or may be secured to the back wall 130 with retention straps (also not shown). In further examples, the backpack straps 138 may extend from the footwear compartment back walls 110 or cross over from the footwear compartment back wall 110 to the gear compartment back wall 130.

The front wall 132 of the gear compartment 126 includes a zippered opening 142 that facilitates access into the gear compartment 126. In the example, the zippered opening 142 is substantially U-shaped and extends from the back wall 130. The zippered opening 142 is disposed on the top face 133*a*, the radius face 133*b*, and the chamfered face 133*c* and includes two zippers that close toward each other. The gear compartment 126 is sized and shaped to receive and store a helmet and/or other skiing/snowboarding gear, and the zippered opening 142 is sized and shaped to allow access thereto. In some examples, along the back wall 130 a reinforced and padded laptop storage sleeve may be included. The laptop storage sleeve may be accessed from an interior of the gear compartment 126 and is sized and shaped to carry a typical laptop or tablet.

The zippered opening 142 may include an exterior smaller securable valuables zipper pocket 144 that is sized to receive keys, wallet, and/or sunglasses for easy access. In the example, the zipper pocket 144 is disposed on the U-shaped flap of the zippered opening 142 and on the top face 133*a*. The zipper pocket 144 may include a single zipper that closes toward the back wall 130. In alternative examples, access into the gear compartment 126 and zipper pocket 144 may include any other closure mechanism such as buttons, flaps, hook-and-loop fasteners, etc. as required or desired. Additionally, the front wall 132 of the gear compartment 126 may include at least one bungee strap 146 and/or D-rings 147 for attaching equipment on the exterior of the travel bag 100, for example, attaching a jacket or a water bottle.

The footwear compartments 104, 106 are secured in the backpack mode 102 via a reversible buckle mechanism 148. The buckle mechanism 148 is coupled to and extends from the front face 113*d* of the front wall 112 of each compartment 104, 106 and extends along the width $W_1$ of the front face 133*d* of the gear compartment 126. At least a portion of the buckle mechanism 148 may be restrained on the gear compartment 126 by one or more retaining straps. In the example, the buckle mechanism 148 is a buckle 150, in alternative examples the buckle mechanism 148 may be any other mechanism to secure the compartments 104, 106 together as described herein, such as hook-and-loop fasteners, straps, magnetic closures, or zippers. The buckle 150 couples the first footwear compartment 104 to the second footwear compartment 106 such the gear compartment 126 is disposed between the compartments 104, 106 and the travel bag 100 is positioned in the backpack mode 102. The position of the buckle mechanism 148 also enables access into each compartment while the travel bag 100 is in the backpack mode 102. Additionally, a single hand strap 151 may extend from the top of the back wall 130 of the gear compartment 126 to facilitate lifting of the travel bag 100 while in the backpack mode 102. In some examples, the hand strap 151 may be reinforced with a plastic arch.

When the convertible travel bag 100 is in the backpack mode 102, the gear and boots contained therein may be easily carried on one's back and free up hands to carry other gear and equipment, for example skis or a snowboard. However, in the backpack mode 102, the travel bag 100 may be difficult to store or stack with other equipment/travel bags. For example, the travel bag 100 may not fit within an airplane overhead storage compartment, or may not pack well in motor vehicles such as trucks, vans, and/or snow machines. Additionally, in the backpack mode 102, the travel bag 100 may be frustrating to carry on one's side with a single hand. As such, to facilitate reducing these types of issues and increasing versatility, the travel bag 100 is quickly and easily convertible into the side-carry mode 120 as described in further detail below. By converting between the backpack mode 102 and the side-carry mode 120, the travel bag 100 is extremely versatile and easy to switch between transportation modes, so as to ease transport and stowage thereof. For example, the travel bag 100 may be converted to the side-carry mode 120 for traveling by plane, train, and car, and may be converted to the backpack mode 102 for walking between each mode of transportation.

Figure 3:
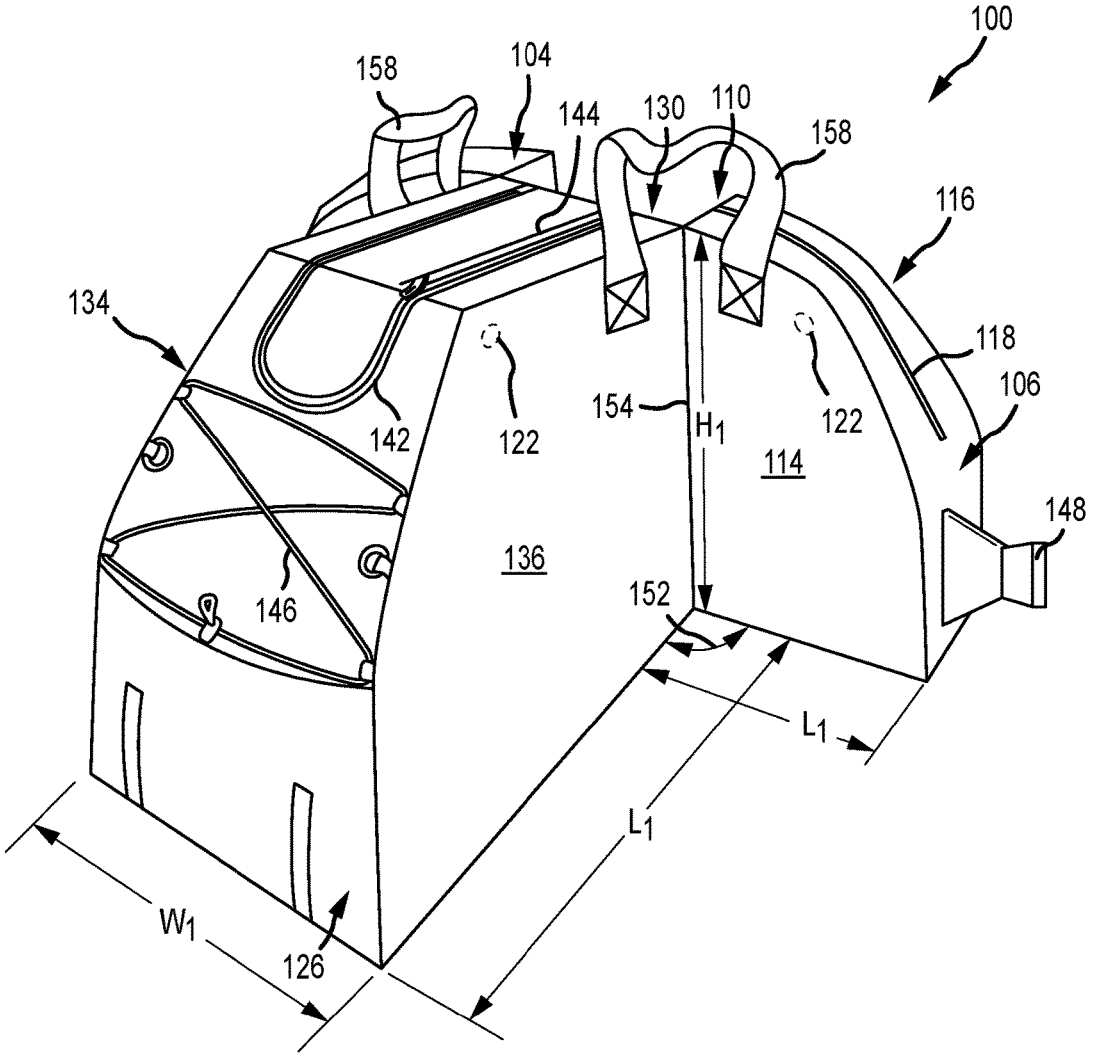
FIG. 3 is a perspective view of the convertible travel bag converting from the backpack mode to a side-carry mode.

FIG. 3 is a perspective view of the convertible travel bag 100 converting from the backpack mode 102 (shown in FIGS. 1 and 2) to the side-carry mode 120 (shown in FIG. 4). To convert the travel bag 100 from the backpack mode 102 to the side-carry mode 120, the buckle mechanism 148 is uncoupled, releasing the first footwear compartment 104 from the second footwear compartment 106. When the footwear compartments 104, 106 are released from one another, each compartment 104, 106 is independently rotatable 152 about a hinge 154. The hinge 154 is defined between the footwear compartment side wall and the gear compartment side walls, and also between the footwear compartment back wall and the gear compartment back wall.

In the example, the hinge 154 is reinforced to resist the stress of the rotation 152. The hinge 154 may be made of a flexible reinforced fabric material, such as the material from which the travel bag 100 is manufactured, or synthetic polymer materials, for example, DELRIN™. The hinge 154 may also be a length of material of a sufficient width that resists repeated folding along a regular line to as to reduce wear. In other examples, the hinge 154 may be in the form of an elongate metal hinge, such as a piano hinge.

The travel bag 100 also includes a pair of handles 158 that facilitate carrying the convertible travel bag 100 from the side while the travel bag 100 is in the side-carry mode 120 (shown in FIG. 4). The handles 158 extend between the side walls of the footwear compartments 104, 106 and the gear compartment 126 such that the handles 158 may be tucked between the side walls and stored when the travel bag is in the backpack mode 102 (shown in FIGS. 1 and 2). In some examples, the handles 158 may be stored within storage compartments (not shown) within the side walls when the travel bag 100 is in the backpack mode 102. In another example, the handles 158 may be secured with retention straps (not shown). In other examples, the handles 158 may only extend from only the gear compartment 126 or only the footwear compartments 104, 106. Additionally, in the example, the handles 158 are adjustable via an adjustment mechanism 159 (shown in FIG. 4) so that a user's arm can extend through to and carry the travel bag 100 over a shoulder.

FIG. 4 is a perspective view of the convertible travel bag 100 in the side-carry mode 120. As described above in reference to FIG. 3, each compartment 104, 106 is rotated about the hinge 154, such that in the side-carry mode 120 the travel bag 100 is elongated and the footwear compartments 104, 106 are in line with the gear compartment 126 and the footwear compartments 104, 106 are disposed adjacent to one another. In the side-carry mode 120, both of the back walls of the footwear compartments 104, 106 are adjacent to and face the back wall of the gear compartment 126. By rotating each footwear compartment 104, 106, the travel bag 100 extends longitudinally 156 to facilitate hand carrying the travel bag 100 as well as increasing ease of storing and stacking with other equipment/travel bags. For example, in the side-carry mode 120, the travel bag 100 may fit within airplane overhead compartments.

In the side-carry mode 120, the bottom walls 108, 128 of all the compartments 104, 106, and 126 forms a bottom 160*a* of the travel bag 100, and since the footwear compartments 104, 106 are rotated approximately 180° in relation to the gear compartment 126, the chamfered face 113*c* and front face 113*d* of the footwear compartments 104, 106 now forms a back 160*b* of the travel bag 100. A top 160*c* of the travel bag 100 is formed by the top faces 113*a*, 133*a* of all the compartments. A front 160*d* of the travel bag 100 is formed by the chamfered face 133*c* and front face 133*d* of the gear compartment 126. A left 160*e* of the travel bag 100 is formed by the first side wall 134 of the gear compartment 126 and a second side wall 116 of the first footwear compartment 104. A right 160*f* of the travel bag 100 is formed by the second side wall 136 of the gear compartment 126 and a first side wall 114 of the second footwear compartment 106.

As such, the bottom 160*a*, the back 160*b*, the top 160*c*, the front 160*d*, the left 160*e*, and the right 160*f* forms an exterior of the travel bag 100. Because the bottom wall 128 of the gear compartment 126 and the bottom walls 108 of each footwear compartment 104, 106 have approximately similar lengths $L_1$ (shown in FIG. 1), the overall length of the travel bag 100 in the side-carry mode 120 is extended to a length $L_2$ which is twice the length of $L_1$. In one example, the length $L_2$ may be approximately 26 inches. The height $H_1$ (shown in FIG. 1) of the travel bag 100 stays the same in the side-carry mode 120 when compared to the backpack mode. Additionally, the width $W_1$ of the front wall 132 of the gear compartment 126 defines the overall width of the travel bag 100 in the side-carry mode 120 which is half of the width $W_3$ (shown in FIG. 1) in the backpack mode. In alternative examples, the width $W_2$ (shown in FIG. 1) of both of the footwear compartments 104, 106 together may be greater than or less than the width $W_1$ of the gear compartment 126 as required or desired. Additionally, in alternative examples, the length $L_1$ of the footwear compartments 104, 106 may be greater than or less than the length $L_1$ of the gear compartment 126 such that the overall length $L_2$ of the travel bag 100 in the side-carry mode 120 is not double in length from the backpack mode.

In the side-carry mode 120, the gear compartment is longitudinally 156 in line with the footwear compartments 104, 106. As such, the second side wall 116 of the first footwear compartment 104 aligns with the first side wall 134 of the gear compartment 126, and the first side wall 114 of the second footwear compartment 106 aligns with the second side wall 136 of the gear compartment 126. The first side wall 114 of the first footwear compartment 104 is positioned adjacent to and faces the second side wall 116 of the second footwear compartment 106 so that they are substantially parallel to one another. Additionally, in the side-carry mode 120 the bottom walls 108 of the footwear compartments 104, 106 align with the bottom wall 128 of the gear compartment 126.

To secure the footwear compartments 104, 106 in the side-carry mode 120, the buckle mechanism (not shown) is coupled about the front faces 113*d* of each footwear compartment 104, 106. In the example, the buckle mechanism is adjustable and reversible such that it is operable in both the side-carry mode 120 and the backpack mode. Additionally, adjacent fasteners 122 on each side wall of the footwear compartments 104, 106 are coupled together to further facilitate the side-carry mode 120 configuration. Additionally, the interior of the gear compartment 126 may include mesh pockets 162 on both side walls 134, 136 to increase storage organization, and a carabiner/key hook 164 handing from the side wall to hold keys.

In the example, the convertible travel bag 100 is a soft-shell fabric construction that may be reinforced in high stress areas, for example, the hinge 154. The fabric may be water-resistant and/or water-proof such that the boots therein remain dry during inclement weather. For example, the fabric may by a layered construction with a waterproof layer and a breathable membrane, such as GORE-TEX™. In some examples, the convertible travel bag 100 may have a support frame such that the shape of the travel bag 100 is maintained when not filled with gear and equipment.

Figure 6:
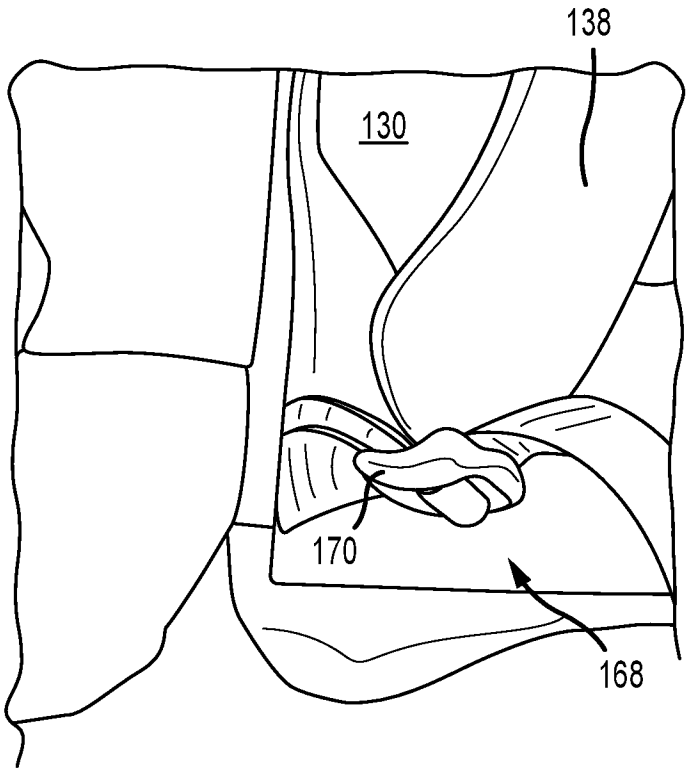
FIG. 6 is an enlarged view of a bottom portion of the backpack strap.
Figure 5:
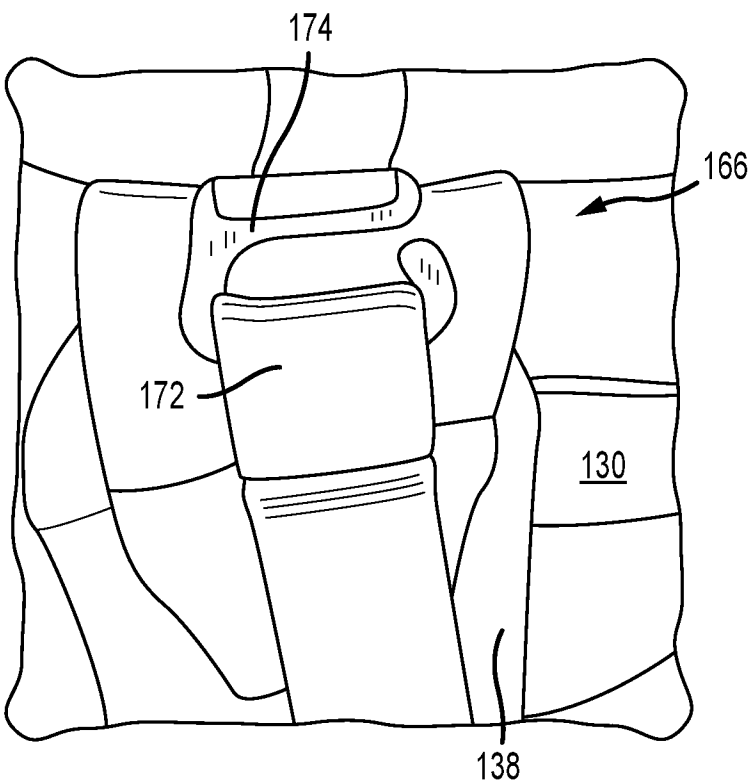
FIG. 5 is an enlarged view of a top portion of a backpack strap for use with the travel bag.

FIG. 5 is an enlarged view of a top portion of the backpack strap 138. FIG. 6 is an enlarged view of a bottom portion of the backpack strap 138. Referring concurrently to FIGS. 5 and 6, the backpack strap 138 extends from a top portion 166 of the back wall 130 of the gear compartment and is adjustably secured to a bottom portion 168 of the back wall 130 via an adjustment mechanism 170. In operation, a free end 172 of the backpack strap 138 is looped through the adjustment mechanism 170 such that the length of the backpack strap 138 is adjustable. When the travel bag is to be positioned in the side-carry mode, the backpack strap 138 may be secured against the back wall 130 by pulling the free end 172 in a direction from the bottom portion 168 towards the top portion 166 to tighten the backpack strap 138 against the back wall 130 and out of the way. The free end 172 may then be secured to a hook 174 positioned proximate the top portion 166. Notably, this adjustment direction of the backpack strap 138 is the opposite of known backpack designs. In this example, a portion of the backpack strap 138 and the back wall 130 is padded for user comfort with additional webbing reinforcement to reduce wear.

Figure 7:
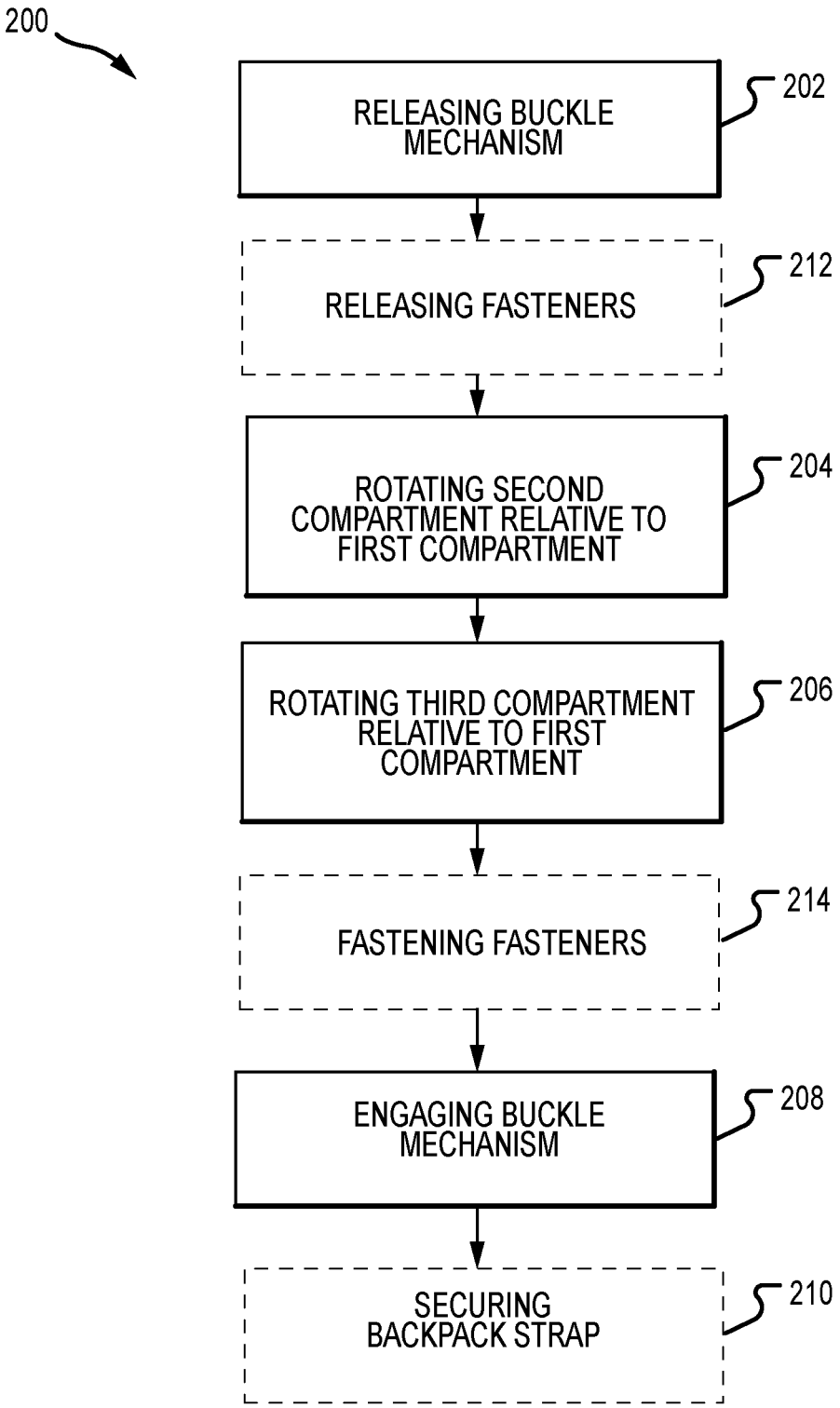
FIG. 7 is a flowchart of an example method of converting a travel bag from a backpack mode to a side-carry mode.

FIG. 7 is a flowchart of an example method 200 of converting a travel bag from a backpack mode to a side-carry mode. In this example, the travel bag includes a first compartment, a second compartment, and a third compartment and is provided in a backpack mode. The first compartment is positioned between the second compartment and the third compartment in the backpack mode. A buckle mechanism is released which couples the second compartment to the third compartment (operation 202). The second compartment can then be rotated relative to the first compartment such that the second compartment is longitudinally in line with the first compartment (operation 204) and the third compartment rotated relative to the first compartment such that the third compartment is longitudinally in line with the first compartment and disposed proximate the second compartment (operation 206). The buckle mechanism is then engaged to couple the second compartment to the third compartment and form the side-carry mode (operation 208).

In some examples, the method 200 may further include securing at least one backpack strap against a back wall of the first compartment (operation 210). In another example, before rotating the second compartment and the third compartment, at least one first fastener securing the second compartment to the first compartment and at least one second fastener securing the third compartment to the first compartment is released (operation 212), and after rotating the second compartment and the third compartment, the at least one third fastener is fastened, securing the second compartment to the third compartment (operation 214).

The convertible travel bag described herein facilitates a travel bag for winter boots, for example, ski and snowboard boots, and quickly and easily converts back and forth from a backpack mode to a slim, side-carry mode. By independently compartmentalizing the boot compartments, rotating the boot compartments around the gear compartment, and reattaching the boot compartments via a buckle mechanism, the convertible travel bag is equally functional as a backpack and a side-carry bag.

While there have been described herein what are to be considered exemplary embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as falling within the spirit and scope of the technology.

What is claimed is:

1. A convertible travel bag comprising:

a first compartment;

a releasable buckle mechanism configured to couple the second compartment to the third compartment in both a backpack mode and a side-carry mode;

a second compartment rotatably coupled to the first compartment; and a third compartment rotatably coupled to the first compartment;

wherein the second compartment and the third compartment are rotatable between the backpack mode and the side-carry mode, and wherein in the backpack mode, the first compartment is positioned between the second compartment and the third compartment and the releasable buckle mechanism spans from the second compartment across the first compartment to the third compartment, and wherein in the side-carry mode, the first compartment is longitudinally in line with both the second compartment and the third compartment and the releasable buckle mechanism spans from the second compartment directly to the third compartment.

2. The convertible travel bag of claim 1, wherein when the convertible travel bag is in the side-carry mode, the second compartment is disposed adjacent to the third compartment.

3. The convertible travel bag of claim 1, wherein the second compartment and the third compartment are each rotatably coupled to the first compartment about a hinge, wherein each hinge comprises a reinforced fabric.

4. The convertible travel bag of claim 1 further comprising a back wall and at least one backpack strap, the at least one backpack strap extends from a top portion of the back wall and is adjustably secured to a bottom portion of the back wall via an adjustment mechanism, and wherein when the convertible travel bag is in the side-carry mode, the at least one backpack strap is configured to be secured against the back wall by pulling a free end of the at least one backpack strap in a direction from the bottom portion towards the top portion.

5. The convertible travel bag of claim 4, wherein the at least one backpack strap comprises a hook positioned proximate the top portion for securing the free end thereto.

6. The convertible travel bag of claim 1, wherein the second compartment and the third compartment are configured to receive and store at least one of a ski boot and a snowboard boot.

7. The convertible travel bag of claim 1, wherein a size as measured by volume of the first compartment is approximately equal to a combined size as measured by volume of the second compartment and the third compartment.

8. A travel bag comprising:

a gear compartment comprising a first back wall, a first side wall, an opposite second side wall, and a front face;

a first footwear compartment comprising a second back wall, a third side wall, and an opposite fourth side wall;

a second footwear compartment comprising a third back wall, a fifth side wall, and an opposite sixth side wall;

a buckle mechanism releasably coupling the first footwear compartment and the second footwear compartment;

wherein the travel bag is configurable between a first carry mode and a second carry mode, and wherein;

when the travel bag is in the first carry mode, the gear compartment is disposed between the first footwear compartment and the second footwear compartment such that the first side wall is positioned adjacent to and faces the fourth side wall and the second side wall is positioned adjacent to and faces the fifth side wall and the buckle mechanism connects the first footwear compartment to the second footwear compartment and is disposed adjacent the first face, and when the travel bag is in the second carry mode, the gear compartment is disposed longitudinally in line with both the first footwear compartment and the second footwear compartment such that the first back wall is positioned adjacent to and faces both the second back wall and the third back wall, and the buckle mechanism connects the first footwear compartment to the second footwear compartment and is disposed remote from the first face.

9. The travel bag of claim 8, wherein when the travel bag is in the first carry mode, all of the back walls, the third side wall, and the sixth side wall form at least a portion of an exterior surface of the travel bag.

10. The travel bag of claim 8, wherein when the travel bag is in the second carry mode, the first side wall, the second side wall, the fourth side wall, and the fifth side wall form at least a portion of an exterior surface of the travel bag.

11. The travel bag of claim 8, wherein each of the side walls comprises one or more fasteners, and wherein the one or more fasteners are configured to secure to an adjacent fastener such that two side walls are secured together.

12. The travel bag of claim 11, wherein the one or more fasteners are positioned towards a top portion of each of the side walls.

13. The travel bag of claim 8, wherein both the first footwear compartment and the second footwear compartment rotate relative to the gear compartment between the first carry mode and the second carry mode.

14. The travel bag of claim 8, wherein the gear compartment further comprises at least one backpack strap extending from the first back wall.

15. The travel bag of claim 8, wherein a longitudinal length of the gear component is approximately equal to a longitudinal length of each of the first footwear compartment and second footwear compartment.

16. A method of converting a travel bag from a backpack mode to a side-carry mode, wherein the travel bag includes a first compartment, a second compartment, a third compartment, and a buckle mechanism the method comprising:

providing the travel bag in the backpack mode wherein the first compartment is disposed between the second compartment and the third compartment and wherein the buckle mechanism couples the second compartment to the third compartment and is disposed adjacent the first compartment;

releasing the buckle mechanism;

rotating the second compartment relative to the first compartment such that the second compartment is longitudinally in line with the first compartment;

rotating the third compartment relative to the first compartment such that the third compartment is longitudinally in line with the first compartment and is disposed proximate the second compartment; and engaging the buckle mechanism to couple the second compartment to the third compartment to form the side-carry mode.

17. The method of claim 16, wherein the second compartment and the third compartment are rotated approximately 180° between the backpack mode and the side-carry mode.

18. The method of claim 16 further comprising securing at least one backpack strap against a back wall of the first compartment.

19. The method of claim 16, wherein before rotating the second compartment and the third compartment, releasing at least one first fastener securing the second compartment to the first compartment and at least one second fastener securing the third compartment to the first compartment, and after rotating the second compartment and the third compartment, fastening at least one third fastener securing the second compartment to the third compartment.

* * * * *